US011773513B2

(12) United States Patent
Nakamura et al.

(10) Patent No.: US 11,773,513 B2
(45) Date of Patent: Oct. 3, 2023

(54) DEVICE AND METHOD FOR MANUFACTURING FIBER ASSEMBLY

(71) Applicant: Panasonic Intellectual Property Management Co., Ltd., Osaka (JP)

(72) Inventors: Taichi Nakamura, Osaka (JP); Norihito Tsukahara, Kyoto (JP); Kouji Ikeda, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/660,643

(22) Filed: Apr. 26, 2022

(65) Prior Publication Data

US 2022/0372659 A1 Nov. 24, 2022

(51) Int. Cl.

| | |
|---|---|
| ***D01D 5/18*** | (2006.01) |
| ***D01D 5/08*** | (2006.01) |
| ***D01D 4/02*** | (2006.01) |
| ***D01D 5/04*** | (2006.01) |

(52) U.S. Cl.

CPC ..... *D01D 5/18* (2013.01); *D01D 4/02* (2013.01); *D01D 5/04* (2013.01)

(58) Field of Classification Search

CPC .. D01D 5/0092; D01D 5/0084; D01D 5/0076; D01D 4/02; D01D 5/18; D01D 5/04

See application file for complete search history.

(56) References Cited

U.S. PATENT DOCUMENTS

| | | | | |
|---|---|---|---|---|
| 2,067,251 A * | 1/1937 | Taylor | D01D 5/04 | 264/168 |
| 2,116,942 A * | 5/1938 | Formhals | D01D 7/00 | 425/174 |
| 2,123,992 A * | 7/1938 | Formhals | D01D 5/0076 | 425/174 |

(Continued)

FOREIGN PATENT DOCUMENTS

| | | |
|---|---|---|
| JP | 2018-007608 | 1/2018 |
| JP | 2018-139528 | 9/2018 |
| JP | 2020-079459 | 5/2020 |

*Primary Examiner* — Emmanuel S Luk

(74) *Attorney, Agent, or Firm* — WENDEROTH, LIND & PONACK, L.L.P.

(57) ABSTRACT

A device for manufacturing a fiber assembly includes: a rotating body that has a cylindrical shape, and winds and holds a plurality of support sheets around an outer peripheral surface around a rotation axis of the rotating body; a plurality of supply nozzles arranged along a direction parallel to the rotation axis, the supply nozzles supplying a polymer material to be a material of fibers to the plurality of support sheets; a supply nozzle moving unit that relatively moves the plurality of supply nozzles in the direction parallel to the rotation axis of the rotating body, in which the rotating body is rotatable about the rotation axis to wind, on main surfaces of the plurality of support sheets, fibers obtained by naturally cooling or naturally drying the polymer material supplied from the plurality of supply nozzles, and the rotating body includes a plurality of guide members in an annular shape circumscribing the outer peripheral surface of the rotating body concentrically to regulate positions of the plurality of support sheets.

5 Claims, 7 Drawing Sheets

(56) References Cited

U.S. PATENT DOCUMENTS 2,160,962 A * 6/1939 Formhals ..... D01D 5/0076 422/186.04
2,347,036 A * 4/1944 Dumont ..... D01D 5/18 264/339
4,323,525 A * 4/1982 Bornat ..... A61F 2/06 264/441
8,522,520 B2 * 9/2013 Smit ..... D01D 5/0076 57/200
10,196,757 B1 * 2/2019 Chen ..... D01D 5/0061
10,633,766 B2 * 4/2020 Haff ..... D01D 5/0076
10,640,888 B1 * 5/2020 Haff ..... D04H 1/728
11,208,735 B2 * 12/2021 Haff ..... D01D 5/0084
2007/0131235 A1 * 6/2007 Janikowski ..... B01D 39/2017 131/332
2009/0324950 A1 * 12/2009 Kim ..... D01D 7/00 428/400
2010/0233115 A1 * 9/2010 Patel ..... A61L 27/54 425/174.8 E
2011/0180972 A1 * 7/2011 Lee ..... D01D 10/02 264/465
2013/0268062 A1 * 10/2013 Puckett ..... D04H 1/728 156/190
2013/0337101 A1 * 12/2013 McGrath ..... A61L 27/50 425/174.8 E
2014/0284827 A1 * 9/2014 Pokorny ..... D01D 5/0076 264/6
2014/0331893 A1 * 11/2014 Salmela ..... D01D 5/11 264/211
2015/0342719 A1 * 12/2015 Chen ..... D01D 5/0076 428/221
2018/0202074 A1 * 7/2018 Uchida ..... D01D 5/0061
2018/0291527 A1 * 10/2018 Beachley ..... D04H 1/728
2019/0071796 A1 * 3/2019 Parikh ..... A61K 31/5383
2019/0119830 A1 * 4/2019 Janssen ..... D04H 1/70
2019/0134267 A1 * 5/2019 Francis ..... A61L 27/3804
2019/0338445 A1 * 11/2019 Haff ..... D01D 5/0092
2019/0390375 A1 * 12/2019 Liukkonen ..... D01F 4/00
2020/0385889 A1 * 12/2020 Janssen ..... D01D 5/0038
2020/0407880 A1 * 12/2020 Madou ..... B29C 48/02
2021/0198808 A1 * 7/2021 Solberg ..... B05B 5/0255
2023/0021972 A1 * 1/2023 Geus ..... D04H 1/56
2023/0024499 A1 * 1/2023 Kohse ..... D01D 5/34

* cited by examiner

DEVICE AND METHOD FOR MANUFACTURING FIBER ASSEMBLY

BACKGROUND

1. Technical Field

The present disclosure relates to a device and a method for manufacturing a fiber assembly including a plurality of intersecting fibers.

2. Description of the Related Art

In recent years, a fiber base material has attracted attention as a culture scaffold for culturing biological tissues and microorganisms. In particular, when a growth of biological tissues and microorganisms is directional, it is desirable that fibers constituting the fiber base material are arranged in a certain direction, and a method of enhancing the arrangement by depositing the fibers so as to circle around a peripheral surface of a winding rotating body is known (See, for example, PTL 1).

CITATION LIST

Patent Literature

PTL 1: Unexamined Japanese Patent Publication No. 2020-79459

SUMMARY

A device for manufacturing a fiber assembly according to an aspect of the present disclosure includes: a rotating body that has a cylindrical shape, and winds and holds a plurality of support sheets around an outer peripheral surface around a rotation axis of the rotating body; a plurality of supply nozzles arranged along a direction parallel to the rotation axis, the supply nozzles supplying a polymer material to be a material of fibers to the support sheets; and a supply nozzle moving unit that relatively moves the supply nozzles in the direction parallel to the rotation axis of the rotating body, in which the rotating body is rotatable about the rotation axis to wind, on main surfaces of the plurality of support sheets, fibers obtained by naturally cooling or naturally drying the polymer material supplied from the plurality of supply nozzles, and the rotating body includes a plurality of guide members in an annular shape circumscribing the outer peripheral surface of the rotating body concentrically to regulate positions of the plurality of support sheets.

DETAILED DESCRIPTIONS

Figure 1:
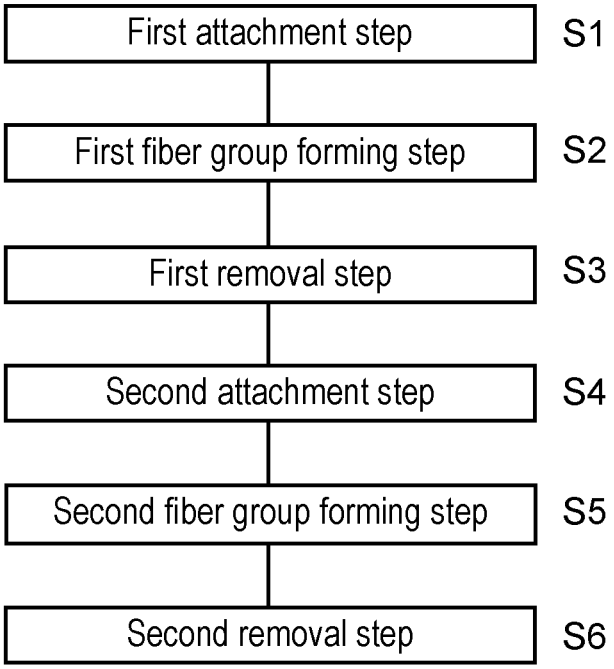
FIG. 1 is a flowchart illustrating a manufacturing method according to a first exemplary embodiment.

In a method of manufacturing a fiber assembly described in PTL 1, fibers having a line width of $\phi$ μm or less has an excellent arrangement, but when a diameter of a rotating body that winds the fibers is increased for improving productivity, a contact pressure of the fibers with respect to the rotating body is reduced. As a result, there is a problem that the arrangement of the fibers is lowered.

As a result of intensive studies on this problem, it has been found that when the rotating body has a heating function, a coefficient of friction (adhesion force) of the fibers with respect to the rotating body is increased, so that the arrangement is improved. However, when the diameter of the rotating body is increased in order to further improve productivity, a temperature of the rotating body also needs to be further increased in order to maintain the arrangement. The present inventors have grasped that there is a problem that when the temperature of the rotating body increases and reaches a certain temperature or higher, the viscosity of the fibers excessively decreases, and the fibers are fused.

Therefore, it is necessary to achieve both the arrangement of the fibers and the improvement in productivity by measures other than increasing the diameter of the rotating body that winds the fibers.

The present disclosure has been made in view of the above, and an object of the present disclosure is to provide a device for manufacturing a fiber assembly that achieves both fiber arrangement and productivity improvement.

A device for manufacturing a fiber assembly according to a first aspect includes: a rotating body that has a cylindrical shape, and winds and holds a plurality of support sheets around an outer peripheral surface around a rotation axis of the rotating body; a plurality of supply nozzles arranged along a direction parallel to the rotation axis, the supply nozzles supplying a polymer material to be a material of fibers to the plurality of support sheets; and a supply nozzle moving unit that relatively moves the plurality of supply nozzles in the direction parallel to the rotation axis of the rotating body, in which the rotating body is rotatable about the rotation axis to wind, on main surfaces of the plurality of support sheets, fibers obtained by naturally cooling or naturally drying the polymer material supplied from the plurality of supply nozzles, and the rotating body includes a plurality of guide members in an annular shape circumscribing the outer peripheral surface of the rotating body concentrically to regulate positions of the plurality of support sheets.

In the device for manufacturing a fiber assembly according to a second aspect, in the first aspect, each of the plurality of guide members may include a cutout part in a part of the annular shape, the rotating body may include an adhesive member that is provided on the outer peripheral surface of the rotating body in a direction of the rotation axis and fixes the plurality of support sheets to the rotating body, and the cutout part may not straddle an upper part of the adhesive member.

In the device for manufacturing a fiber assembly according to a third aspect, in the first or second aspect, each of the plurality of guide members may have a thickness larger than or equal to a thickness of each of the support sheets.

In the device for manufacturing a fiber assembly according to a fourth aspect, in the second aspect, each of the plurality of support sheets may be fixed to the adhesive member to form a gap portion between end surfaces of the plurality of support sheets, and the cutout part of each of the plurality of guide members and the gap portion between the end surfaces of the plurality of support sheets may be in a same linear relationship with respect to the direction of the rotation axis of the rotating body.

A method for manufacturing a fiber assembly according to a fifth aspect is a method for manufacturing a fiber assembly using the device for manufacturing a fiber assembly according to any one of the first to fourth aspects, the method including: a first attachment step of winding and attaching a plurality of support sheets having flexibility around an outer peripheral surface of a rotating body; a step of forming a first fiber group by arranging first fibers on a first main surface facing outward of each of the plurality of support sheets to circle around the outer peripheral surface of the rotating body; a second attachment step of winding and attaching the plurality of support sheets around the outer peripheral surface of the rotating body, the first main surface of each of the plurality of support sheets facing outward, and a direction in which the first fibers of the first fiber group on each of the plurality of support sheets extend being different from a circumferential direction of the outer peripheral surface of the rotating body; and a step of forming a second fiber group by arranging second fibers on the first main surface of each of the plurality of support sheets to cross the first fiber group and circle around the outer peripheral surface of the rotating body, wherein in the first attachment step and the second attachment step, the plurality of support sheets are wound around and attached to the outer peripheral surface of the rotating body while regulating positions by making individual end surfaces of the plurality of support sheets follow side surfaces of a plurality of guide members concentrically circumscribing the outer peripheral surface of the rotating body and provided in an annular shape.

In the method for manufacturing a fiber assembly according to a sixth aspect, in the fifth aspect, in the step of forming the first fiber group and the step of forming the second fiber group, with respect to the plurality of support sheets that are wound around and fixed to the outer peripheral surface of the rotating body by the guide members included in the rotating body and rotate, by spinning fibers substantially in parallel while a plurality of supply nozzles that supply the fibers and correspond to each of the plurality of support sheets relatively move in a direction parallel to a rotation axis, the first fiber group and the second fiber group in which the fibers are arranged in parallel may be arranged.

According to the present disclosure, in a device and a method for manufacturing a fiber assembly including a plurality of arranged fibers, it is possible to improve the productivity of the fiber assembly while maintaining the arrangement of the fibers without increasing a diameter of the rotating body that winds the fibers.

Hereinafter, a device for manufacturing a fiber assembly and a method for manufacturing a fiber assembly according to exemplary embodiments will be described with reference to the accompanying drawings. Note that, in the drawings, substantially the same members are designated by the same reference marks.

First Exemplary Embodiment

<Device for Manufacturing Fiber Assembly>

Figure 4:
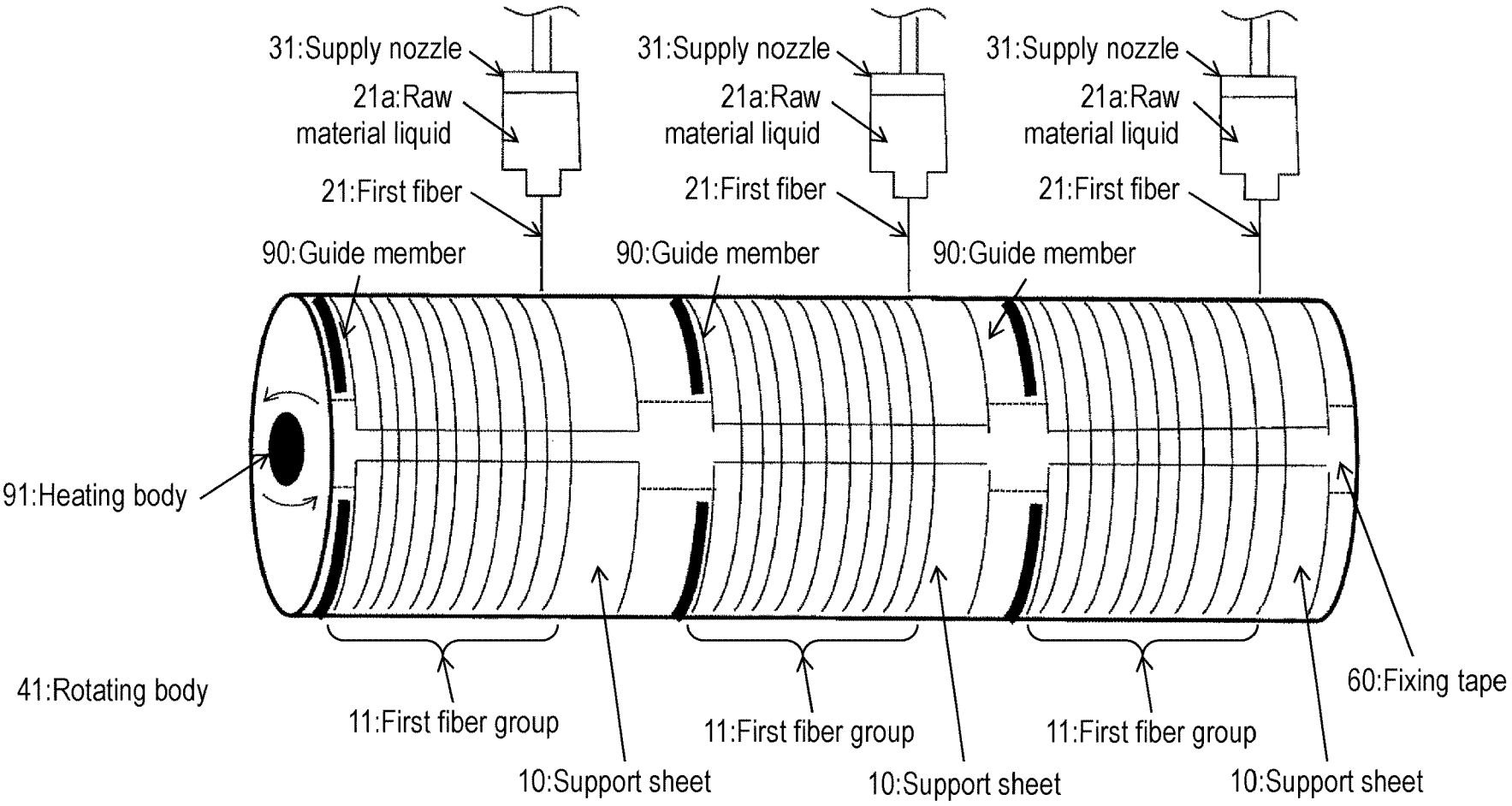
FIG. 4 is a perspective view illustrating an example of a first fiber forming step according to the first exemplary embodiment.

FIG. 4 is a schematic diagram illustrating a configuration of a device for manufacturing a fiber assembly according to a first exemplary embodiment.

The device for manufacturing a fiber assembly according to the first exemplary embodiment includes rotating body 41, a plurality of supply nozzles 31, and a supply nozzle moving unit (not illustrated). Rotating body 41 has a cylindrical shape and holds a plurality of support sheets 10 so as to be wound around an outer peripheral surface around a rotation axis. Each of supply nozzles 31 extrudes a polymer material to be a fiber material in a molten or solution state, and supplies the polymer material to each of support sheets 10. Further, the plurality of supply nozzles 31 are disposed along a direction parallel to the rotation axis. The supply nozzle moving unit relatively moves supply nozzles 31 in the direction parallel to the rotation axis of rotating body 41. Rotating body 41 is rotatable about the rotation axis such that fibers obtained by naturally cooling or naturally drying the polymer material supplied from the plurality of supply nozzles 31 are wound on main surfaces of the plurality of support sheets 10. Further, rotating body 41 includes a plurality of annular guide members 90 circumscribing the outer peripheral surface of rotating body 41 concentrically so as to regulate positions of the plurality of support sheets 10.

According to the device for manufacturing a fiber assembly according to the first exemplary embodiment, the plurality of supply nozzles and the supply nozzle moving unit can improve the productivity of the fiber assembly while maintaining the arrangement of the fibers without increasing the diameter of the rotating body that winds the fibers.

<Method for Manufacturing Fiber Assembly>

Next, a method for manufacturing a fiber assembly according to the present exemplary embodiment will be described.

FIG. 1 is a flowchart illustrating a method for manufacturing a fiber assembly according to the first exemplary embodiment.

(1) In the first exemplary embodiment, the support sheets are attached so as to be wound around the outer peripheral surface of the rotating body (S1).

(2) Then, the rotating body is rotated about the rotation axis. At this time, for example, by relatively moving the supply nozzles for supplying first fibers (alternatively, raw material liquids) along the direction of the rotation axis, the plurality of first fibers are arranged so as to circle around circumferential surfaces of the cylindrical support sheets, and first fiber groups having high arrangement are formed (S2).

(3) Next, the first fiber groups at the portions where the support sheets are wound and opposed are cut, and the first fiber groups are removed from the rotating body together with the support sheets (S3).

(4) Next, for example, the support sheets detached from the rotating body together with the first fiber groups are rotated by 90° and attached so as to be wound around the rotating body (S4). That is, the support sheets are wound around and attached to the outer peripheral surface of the rotating body such that a direction in which the first fibers of the first fiber groups on the support sheets extend is different from a circumferential direction of the outer peripheral surface of the rotating body.

Here, since the support sheets can be deformed without applying an excessive load to the first fiber groups due to their flexibility, it is possible to handle the support sheets without impairing the arrangement of the first fiber groups.

(5) Next, the rotating body is rotated about the rotation axis. At this time, for example, by relatively moving the supply nozzles for supplying second fibers (alternatively, raw material liquids) along the direction of the rotation axis, the plurality of second fibers are arranged on first main surfaces of the support sheets so as to cross the first fiber groups and circle around the outer peripheral surface of the rotating body, thereby forming second fiber groups (S5).

(6) Finally, the support sheets are wound to cut the second fiber groups at opposing portions, and the first fiber groups and the second fiber groups are removed from the rotating body together with the support sheets to obtain a fiber assembly in which the first fiber groups and the second fiber groups having a high degree of arrangement are formed (S6).

Next, a relationship with a device for manufacturing a fiber assembly for embodying the manufacturing method according to the first exemplary embodiment described above will be described.

Details of an example of the first attachment step (S1) and the second attachment step (S4) according to the first exemplary embodiment will be described with reference to a perspective view of FIG. 2 and a cross-sectional view of FIG. 3.

Figure 2:
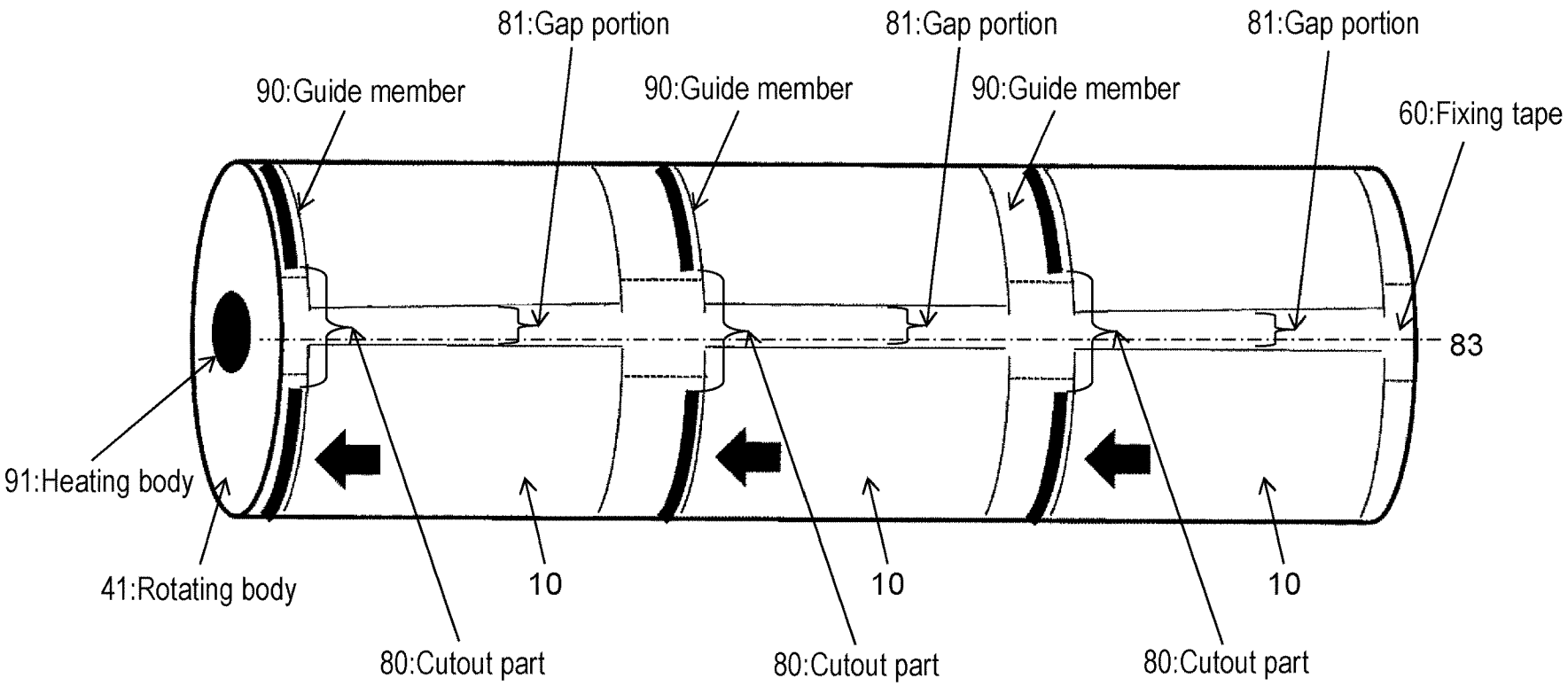
FIG. 2 is a perspective view illustrating an example of a first attachment step and a second attachment step according to the first exemplary embodiment.
Figure 3:
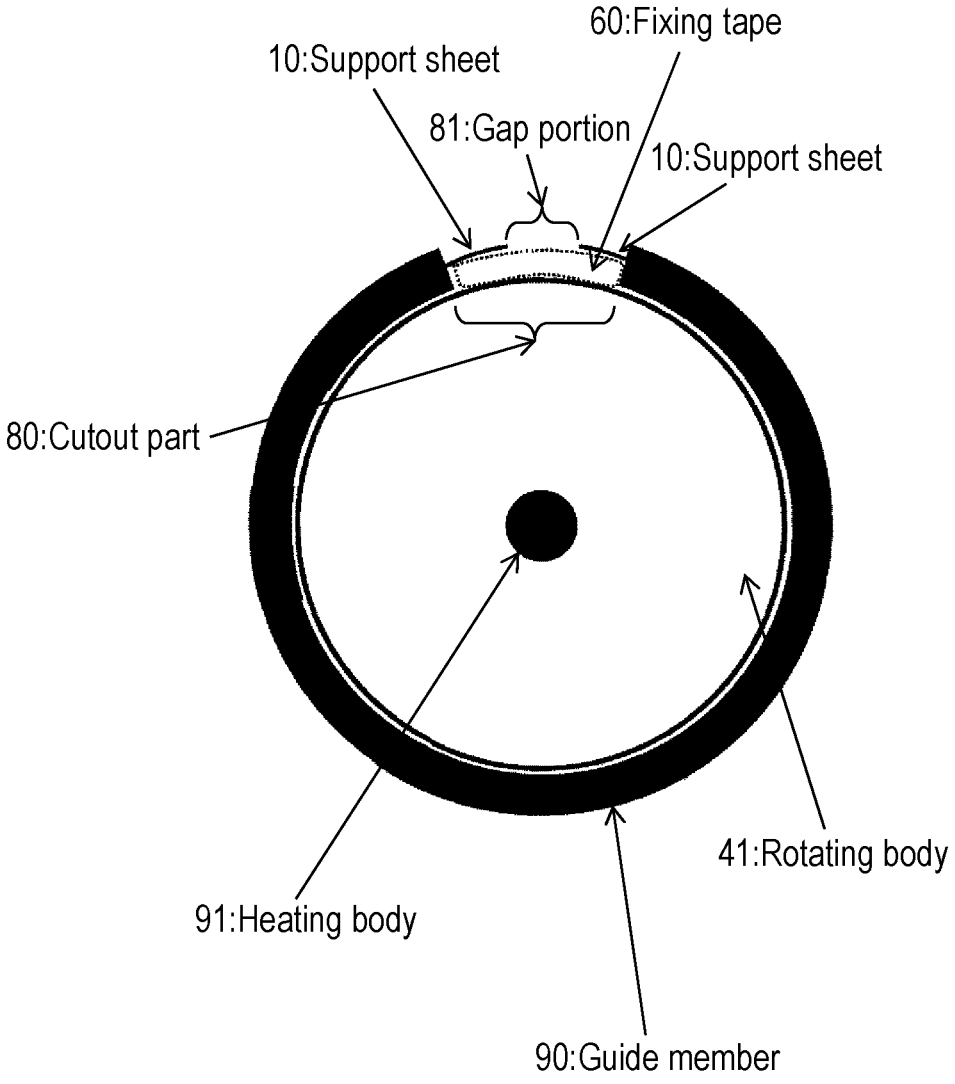
FIG. 3 is a cross-sectional view illustrating an example of the first attachment step and the second attachment method according to the first exemplary embodiment.

As described above in the description of the first attachment step (S1), the plurality of support sheets 10 are attached to long rotating body 41 via fixing tape 60 (FIG. 2 illustrates a case where there are three support sheets).

Further, each of support sheets 10 is attached by winding each support sheet around the outer peripheral surface of the rotating body while regulating the positions of the plurality of support sheets by making individual end surfaces follow side surfaces of the plurality of annular guide members 90 circumscribing the outer peripheral surface of the rotating body concentrically as indicated by black arrows in FIG. 2.

In the present exemplary embodiment, polyethylene terephthalate (PET) having a thickness of 75 μm is used for support sheets 10, but the material is not particularly limited, and a resin such as polyester or polyimide, or a rubber such as silicone rubber may be used. The thickness may be set according to the properties of the first fiber groups and/or the second fiber groups, and may be, for example, 20 μm or more and 260 μm or less when the material is PET so that both self-support and flexibility can be achieved.

Further, for fixing tape 60, a thin film silicone resin and polypropylene (PP) having a thickness of 50 μm are used as an adhesive layer and a base layer, but the materials are not particularly limited to those described above. As the adhesive layer, an acrylic resin, a urethane resin, a natural rubber, a synthetic rubber, or the like may be used. As the base layer, a resin such as polyimide or polyamide may be used, but the thickness of the base layer is desirably less than or equal to 100 μm from the viewpoint of not impairing the arrangement of the first fiber group and/or the second fiber group of S2 and S4.

Furthermore, although polyurethane having a thickness of 200 μm is used for guide members 90, the material is not particularly limited, and a resin such as polyimide or polyamide may be used. Note that, as illustrated in FIG. 3, the thickness is desirably larger than or equal to the thickness of support sheets 10 in view of ease of regulating the positions of support sheets 10.

Here, as described in the first attachment step (S1) and the second attachment step (S4), when each of support sheets 10 is attached by being pressed against fixing tape 60, a corner portion of each support sheet 10 and cutout part 80 of each of the guide member are adjacent to each other. That is, since the corner portion of support sheet 10 and each of the guide members are not adjacent to each other, the corner portion of support sheet 10 can be easily pressed perpendicularly to fixing tape 60, and the fixability can be secured.

In addition, in order to collectively cut the first fiber groups and/or the second fiber groups (not illustrated) described above in the description of the first removal step (S3) and the second removal step (S6) on the rotating body, cutout part 80 of each of the guide members and gap portion 81 between the end surfaces of the support sheet fixed on the adhesive member are in the same linear relationship in the direction of the rotation axis of the rotating body. That is, a plurality of cutout parts 80 are arranged on straight line 83 parallel to the direction of the rotation axis of rotating body 41. Similarly, a plurality of gap portions 81 are arranged on straight line 83.

Details of an example of the first fiber group forming step (S2) according to the first exemplary embodiment will be described with reference to a perspective view of FIG. 4.

As described above in the description of the first fiber group forming step (S2), while applying raw material liquids 21*a* filled in supply nozzles 31 corresponding to individual support sheets 10 onto the main surfaces of the plurality of support sheets 10 attached to rotating body 41 via fixing tape 60, the rotating body is rotated to relatively move supply nozzles 31 along the axial direction. As a result, a plurality of first fibers 21 are arranged so as to circle around peripheral surfaces of the cylindrical support sheets, and first fiber groups 11 each having an average fiber diameter of 3 μm and a fiber interval of 10 μm are formed.

Here, by relatively moving supply nozzles 31 individually corresponding to the plurality of support sheets 10 along the rotation axis direction, it is possible to arrange first fibers 21 only on the individually corresponding support sheets 10, and avoid arranging first fibers 21 in a part where support sheets 10 do not exist. This makes it possible to handle the support sheets without hindering the workability and arrangement when cutting the first fiber groups in the first removal step (S3).

Further, the average fiber diameter and the fiber interval of the first fiber groups 11 to be arranged are not particularly limited, and may be appropriately set according to the application.

The fiber diameter may be, for example, 0.5 μm or more and 30 μm or less, and even such a thin wire diameter can be arranged with high arrangement according to the present exemplary embodiment.

Here, the average fiber diameter is an average value of the diameters of the fibers, the diameter of the fibers is a diameter of a cross section perpendicular to a length direction of the fibers, and when the cross section is not circular, the maximum diameter may be regarded as the diameter, and the width in a direction perpendicular to the length direction of the fibers may be regarded as the diameter of the fibers.

The average fiber diameter is, for example, an average value of diameters at arbitrary positions of arbitrary 10 fibers contained in the fiber assembly. That is, the average fiber diameter is an average value of the diameters of the fibers.

Raw material liquids 21*a* contain a raw material of first fibers 21 and a solvent for dissolving the raw material, and in the present exemplary embodiment, a solution in which polystyrene (PS) is dissolved in N, N-dimethylacetamide is used.

The raw material of the first fibers is not particularly limited, and the fibers can be formed by a spinning method, and examples of the material that can be formed into a solution and spun include not only polystyrene but also silicone, polyurethane, and silicone polyurethane copolymer collagen.

Further, examples of a material that can be spun by melting a raw material by heating without using a solvent include polylactide (PLA), poly-L-lactic acid (PLLA), polyglycolide (PGA), and a lactic acid-glycolic acid copolymer (PLGA).

In addition, the raw material is not limited to a polymer alone, and an inorganic filler may be dispersed in a material containing a polymer as a main component, for example, in order to impart certain conductivity.

Next, in order to maintain a high degree of arrangement, adhesion between first fibers 21 and support sheets 10 may be promoted by appropriately heating rotating body 41 using heating body 91.

Figure 5:
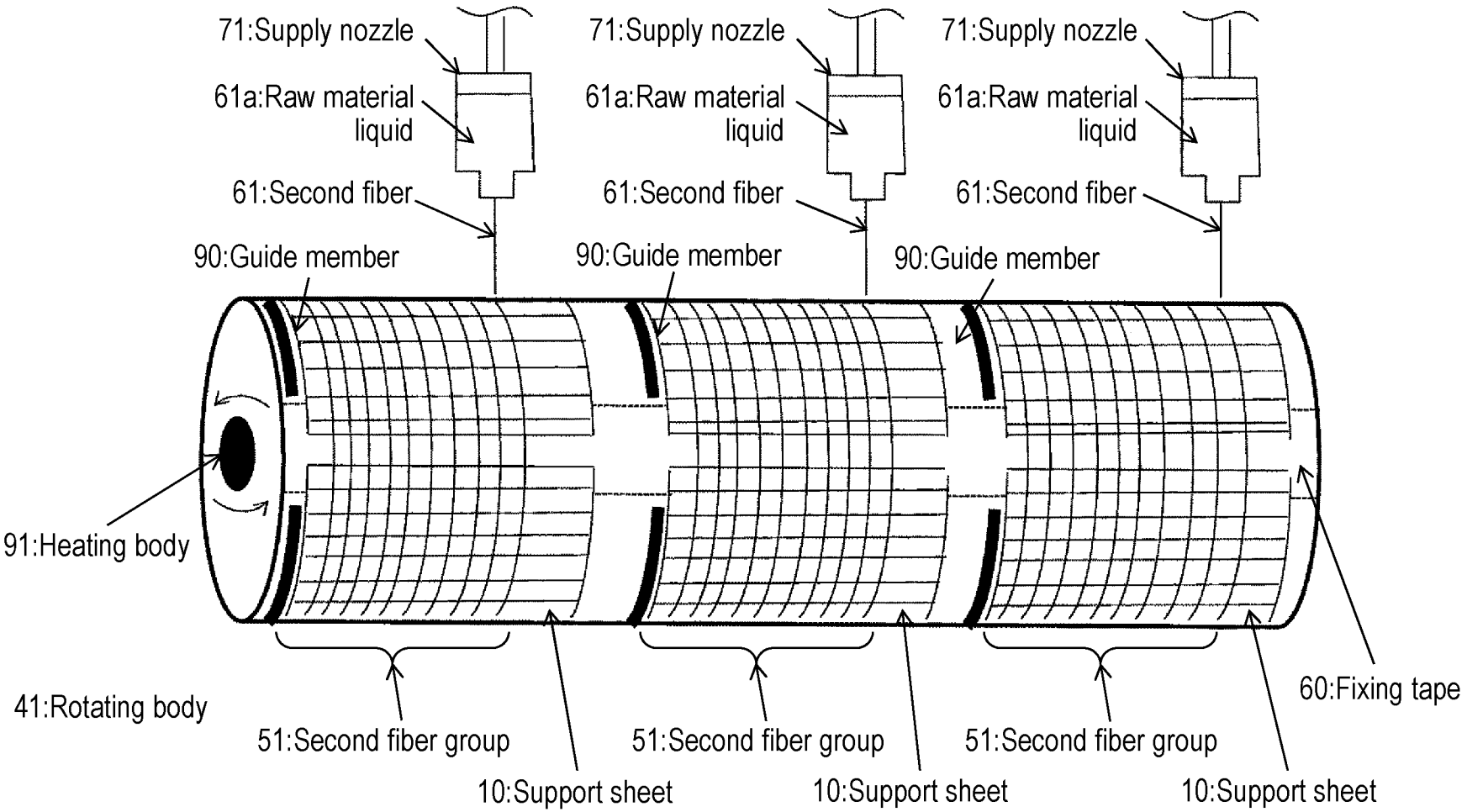
FIG. 5 is a perspective view illustrating an example of a second fiber forming step according to the first exemplary embodiment.

Details of an example of the second fiber group forming step (S5) according to the first exemplary embodiment will be described with reference to a perspective view of FIG. 5.

As described above in the description of the second fiber group forming step (S5), while applying raw material liquids 61*a* filled in supply nozzles 71 corresponding to individual support sheets 10 onto the main surfaces of the plurality of support sheets 10 attached to the rotating body 41 via fixing tape 60, the rotating body is rotated to relatively move supply nozzles 71 along the axial direction. As a result, second fiber groups 51 each having an average diameter of 3 μm and a fiber interval of 10 μm are formed in which a plurality of second fibers 61 are arranged so as to circle around via first fiber groups 11 on the support sheets and cross first fiber groups 11.

Here, by relatively moving supply nozzles 71 individually corresponding to the plurality of support sheets 10 along the rotation axis direction, it is possible to arrange second fibers 61 only on individually corresponding support sheets 10, and avoid that second fibers 61 are arranged in a part where support sheets 10 do not exist. This makes it possible to handle the support sheets without hindering the workability and arrangement when cutting the second fiber groups in the second removal step (S6).

Further, the average fiber diameter and the fiber interval of second fiber groups 51 to be arranged are not particularly limited, and may be appropriately set according to the application.

The fiber diameter may be, for example, 0.5 μm or more and 30 μm or less, and even such a thin wire diameter can be arranged with high arrangement according to the present exemplary embodiment.

Raw material liquids 61*a* contain a raw material of second fibers 61 and a solvent for dissolving the raw material, and in the present exemplary embodiment, a solution in which polystyrene (PS) is dissolved in N, N-dimethylacetamide is used.

The raw material of the second fibers is not particularly limited as long as it is a material that can form fibers by a spinning method and can be formed into a solution and spun, and the raw material of the second fibers is not limited to polystyrene, and examples thereof include silicone, polyurethane, and silicone polyurethane copolymer collagen.

Further, examples of a material that can be spun by melting a raw material by heating without using a solvent include polylactide (PLA), poly-L-lactic acid (PLLA), polyglycolide (PGA), and a lactic acid-glycolic acid copolymer (PLGA).

In addition, the raw material is not limited to a polymer alone, and an inorganic filler may be dispersed in a material containing a polymer as a main component, for example, in order to impart certain conductivity.

Next, in order to maintain a high degree of arrangement, adhesion between first fiber groups 11 and second fiber groups 51 may be promoted by appropriately heating rotating body 41 using heating body 91. Furthermore, in order to further promote the adhesiveness between first fiber groups 11 and second fiber groups 51 after completion of spinning, rotating body 41 may be appropriately heated using heating body 91 to a temperature range higher than or equal to melting points of first fiber groups 11 and second fiber groups 51 and in which they are not fused.

Next, FIGS. 6A to 6D are schematic diagrams illustrating a series of steps of bonding the fiber groups to a container through a frame body in a fiber assembly according to the first exemplary embodiment.

Figure 6A:
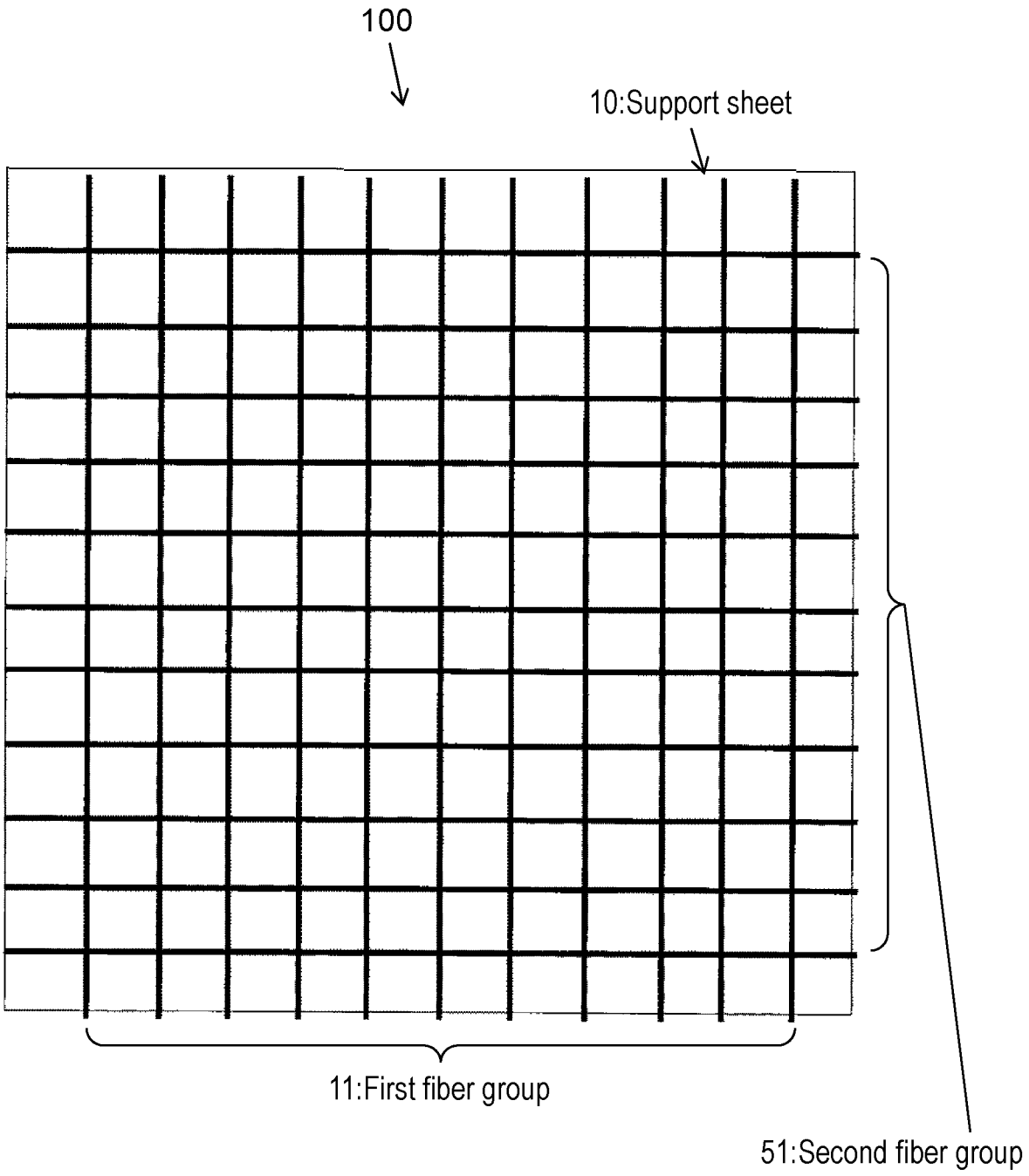
FIG. 6A is a plan view of a fiber assembly according to the first exemplary embodiment.

FIG. 6A is a plan view from an upper surface of fiber assembly 100 according to the present exemplary embodiment.

Figure 6B:
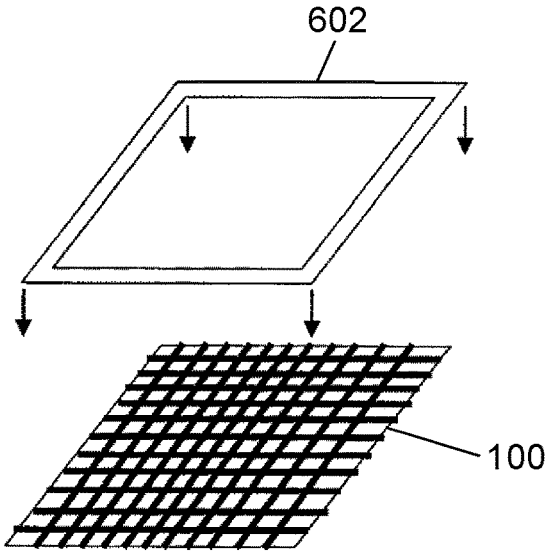
FIG. 6B is a perspective view illustrating a part of an operation of pressing and bonding a frame body to the fiber assembly of FIG. 6A.

FIG. 6B is a perspective view illustrating a part of an operation of pressing and bonding frame body 602 to fiber assembly 100 prepared in FIG. 6A.

Figure 6C:
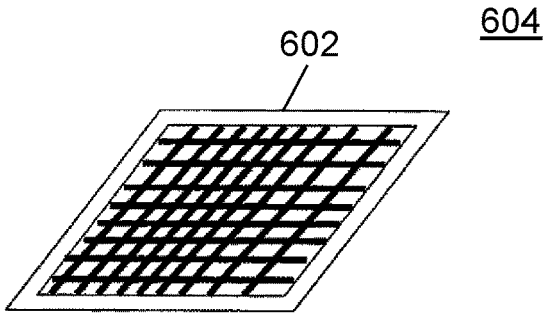
FIG. 6C is a perspective view illustrating a state in which the frame body is bonded to the fiber assembly of FIG. 6A, and a support sheet is peeled off to make a fiber group self-standing.

FIG. 6C is a perspective view after frame body 602 of FIG. 6B is peeled off from support sheet 10.

An adhesive layer (not illustrated) is coated on a surface of frame body 602 on a side facing a main surface of support sheet 10 including first fiber group 11 and second fiber group 51, and when the frame body is peeled off after being pressed against support sheet 10, fiber group 604 including first fiber group 11 and second fiber group 51 can be transferred to an adhesive layer of frame body 602. As a result, support sheet 10 can be peeled off, and fiber group 604 can be made self-standing.

Figure 6D:
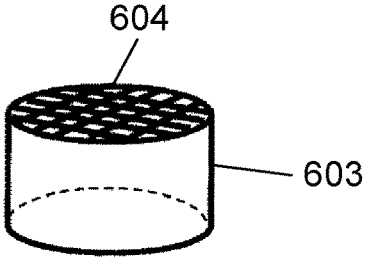
FIG. 6D is a perspective view illustrating a container in which the self-standing fiber group of FIG. 6C is bonded to an opening.

FIG. 6D is a perspective view illustrating a container in which fiber group 604 self-standing via frame body 602 in FIG. 6C is bonded to an opening.

In the present exemplary embodiment, polystyrene is used for container 603, and fiber group 604 is bonded to container 603 by thermocompression bonding to an opening surface of the container, but the thermocompression bonding may not be performed. For example, the bonding may be performed via an adhesive.

As described above, when fiber group 604 is made to stand by itself from fiber assembly 100 having both the arrangement and the productivity and arranged at a desired portion, the fiber assembly can be applied to, for example, a scaffold material for cell culture.

Note that the present disclosure includes appropriate combination of arbitrary exemplary embodiments and/or examples among the various exemplary embodiments and/or examples described above, and effects of the respective exemplary embodiments and/or examples can be exhibited.

According to the fiber assembly and the method for manufacturing the fiber assembly according to the present disclosure, it is possible to apply the fiber assembly including thin and highly arranged fibers to various uses by achieving both arrangement and productivity.

What is claimed is:

1. A device for manufacturing a fiber assembly, the device comprising:

a rotating body that has a cylindrical shape, and winds and holds a plurality of support sheets around an outer peripheral surface around a rotation axis of the rotating body;

a plurality of supply nozzles arranged along a direction parallel to the rotation axis, the supply nozzles supplying a polymer material to be a material of fibers to the plurality of support sheets; and a supply nozzle moving unit that relatively moves the plurality of supply nozzles in the direction parallel to the rotation axis of the rotating body, wherein the rotating body is rotatable about the rotation axis to wind, on main surfaces of the plurality of support sheets, fibers obtained by naturally cooling or naturally drying the polymer material supplied from the plurality of supply nozzles, the rotating body includes a plurality of guide members in an annular shape circumscribing the outer peripheral surface of the rotating body concentrically to regulate positions of the plurality of support sheets, each of the plurality of guide members includes a cutout part in a part of the annular shape, the rotating body further includes an adhesive member that is provided on the outer peripheral surface of the rotating body in a direction of the rotation axis and fixes the plurality of support sheets to the rotating body, and the cutout part does not straddle an upper part of the adhesive member.

2. The device for manufacturing a fiber assembly according to claim 1, wherein each of the plurality of guide members has a thickness larger than or equal to a thickness of each of the support sheets.

3. The device for manufacturing a fiber assembly according to claim 1, wherein each of the plurality of support sheets is fixed to the adhesive member to form a gap portion between end surfaces of the plurality of support sheets, and the cutout part of each of the plurality of guide members and the gap portion between the end surfaces of the plurality of support sheets are in a same linear relationship with respect to the direction of the rotation axis of the rotating body.

4. A method for manufacturing a fiber assembly using the device for manufacturing a fiber assembly according to claim 1, the method comprising:

a first attachment step of winding and attaching a plurality of support sheets having flexibility around the outer peripheral surface of the rotating body;

a step of forming a first fiber group by arranging first fibers on a first main surface facing outward of each of the plurality of support sheets to circle around the outer peripheral surface of the rotating body;

a second attachment step of winding and attaching the plurality of support sheets around the outer peripheral surface of the rotating body, the first main surface of each of the plurality of support sheets facing outward, and a direction in which the first fibers of the first fiber group on each of the plurality of support sheets extend being different from a circumferential direction of the outer peripheral surface of the rotating body; and a step of forming a second fiber group by arranging second fibers on the first main surface of each of the plurality of support sheets to cross the first fiber group and circle around the outer peripheral surface of the rotating body, wherein in the first attachment step and the second attachment step, the plurality of support sheets are wound around and attached to the outer peripheral surface of the rotating body while regulating positions by making individual end surfaces of the plurality of support sheets follow side surfaces of the plurality of guide members concentrically circumscribing the outer peripheral surface of the rotating body and provided in the annular shape.

5. The method for manufacturing a fiber assembly according to claim 4, wherein in the step of forming the first fiber group and the step of forming the second fiber group, with respect to the plurality of support sheets that are wound around and fixed to the outer peripheral surface of the rotating body by the guide members included in the rotating body and rotate, by spinning the fibers substantially in parallel while the plurality of supply nozzles that supply the fibers and correspond to each of the plurality of support sheets relatively move in a direction parallel to the rotation axis, the first fiber group and the second fiber group in which the fibers are arranged in parallel are arranged.

* * * * *